US006316399B1

(12) United States Patent
Melikyan et al.

(10) Patent No.: US 6,316,399 B1
(45) Date of Patent: Nov. 13, 2001

(54) SURFACTANTS BASED AQUEOUS COMPOSITIONS WITH D-LIMONENE AND HYDROGEN PEROXIDE AND METHODS USING THE SAME

(75) Inventors: Arman V. Melikyan; Patrick H. Stewart, both of Danville, IL (US)

(73) Assignee: Envirox, L.L.C., Georgetown, IL (US)

( * ) Notice: Subject to any disclaimer, the term of this patent is extended or adjusted under 35 U.S.C. 154(b) by 0 days.

(21) Appl. No.: 08/799,712

(22) Filed: Feb. 10, 1997

Related U.S. Application Data

(63) Continuation-in-part of application No. 08/578,971, filed on Dec. 27, 1995, now Pat. No. 5,602,090.

(51) Int. Cl.[7] ..... C11D 3/00; C11D 3/18; C11D 3/39

(52) U.S. Cl. ..... 510/372; 510/417

(58) Field of Search ..... 510/417, 365, 510/372, 375

(56) References Cited

U.S. PATENT DOCUMENTS

| | | | | |
|---|---|---|---|---|
| 2,371,545 | | 3/1945 | Riggs et al. | 252/95 |
| 2,886,532 | | 5/1959 | Richmond et al. | 252/104 |
| 3,869,401 | | 3/1975 | Ernst | 252/186 |
| 3,977,826 | * | 8/1976 | Iscowitz | 8/10.2 |
| 4,022,703 | | 5/1977 | Bakes et al. | 252/100 |
| 4,130,501 | | 12/1978 | Lutz et al. | 252/186 |
| 4,146,499 | * | 3/1979 | Rosano | 252/186 |
| 4,230,478 | * | 10/1980 | Zumbrunn | 71/3 |
| 4,362,706 | | 12/1982 | Willard | 423/273 |
| 4,414,128 | * | 11/1983 | Goffinet | 252/111 |
| 4,430,236 | | 2/1984 | Franks | 252/95 |
| 4,472,291 | * | 9/1984 | Rosano | 252/186.28 |
| 4,530,781 | | 7/1985 | Gipp | 252/546 |
| 4,656,043 | * | 4/1987 | Hawkins et al. | 424/70 |
| 4,704,225 | | 11/1987 | Stoufer | 252/153 |
| 4,711,739 | | 12/1987 | Kandathil | 252/139 |
| 4,749,516 | | 6/1988 | Brusky | 252/546 |
| 4,829,897 | | 5/1989 | Wyman et al. | 101/487 |
| 4,877,544 | | 10/1989 | Gabriel et al. | 252/99 |
| 4,900,468 | | 2/1990 | Mitchell et al. | 252/95 |
| 5,008,030 | | 4/1991 | Cook et al. | 252/106 |
| 5,102,575 | | 4/1992 | Lanniel et al. | 252/186.29 |
| 5,130,124 | | 7/1992 | Merianos et al. | 424/53 |
| 5,180,514 | | 1/1993 | Farr et al. | 252/99 |
| 5,213,624 | | 5/1993 | Williams | 134/40 |
| 5,281,280 | | 1/1994 | Lisowski et al. | 134/26 |
| 5,281,354 | | 1/1994 | Faber | 252/154 |
| 5,336,426 | * | 8/1994 | Rader et al. | 252/102 |
| 5,368,867 | | 11/1994 | DaSilva | 424/616 |
| 5,376,297 | | 12/1994 | Choy et al. | 252/108 |
| 5,380,457 | * | 1/1995 | Zielske | 252/186.38 |
| 5,389,157 | * | 2/1995 | Smith | 134/22.13 |
| 5,399,282 | | 3/1995 | Hansen et al. | 252/162 |
| 5,527,486 | | 6/1996 | DeGuertechin | 252/162 |
| 5,531,938 | | 7/1996 | Erilli | 510/417 |
| 5,549,840 | | 8/1996 | Mondin et al. | 510/365 |
| 5,585,034 | * | 12/1996 | Lysy et al. | 510/403 |
| 5,602,090 | * | 2/1997 | Melikyan et al. | 510/372 |
| 5,614,484 | * | 3/1997 | Panandiker | 510/102 |
| 5,653,970 | * | 8/1997 | Vermeer | 424/70.24 |
| 5,696,171 | * | 12/1997 | Rupp et al. | 514/700 |

OTHER PUBLICATIONS

Drew Myers, Surfactant Science and Technology, Second Edition, 1992, pp. 153–155.*

* cited by examiner

*Primary Examiner*—Yogendra N. Gupta
*Assistant Examiner*—John M. Petruncio

(57) ABSTRACT

A cleaning composition including a terpene such as D-limonene or Orange oil and hydrogen peroxide or an alkaline stable peroxide in a surfactants based aqueous solution. The composition in various specific formulations is a micro-emulsion useful for a variety of materials and for both industrial and household applications.

29 Claims, No Drawings

SURFACTANTS BASED AQUEOUS COMPOSITIONS WITH D-LIMONENE AND HYDROGEN PEROXIDE AND METHODS USING THE SAME

RELATED APPLICATION

This is a continuation-in-part of the U.S. patent application Ser. No. 08/578,971, filed Dec. 27, 1995, which issued on Feb. 11, 1997, as U.S. Pat. No. 5,602,090.

BACKGROUND OF THE INVENTION

This invention relates to improved cleaning compositions and methods of using the same. More specifically, it relates to aqueous compositions which are surfactant based and include monoterpenes or sequiterpenes or mixtures of both, such as technical grade D-limonene or orange oil, and hydrogen peroxide or an alkaline-stable peroxide.

Many different cleaning compositions have been developed for a variety of purposes. The art is replete with patents on such compositions. Depending on the specific materials to be cleaned and the uses of those materials, different results may be more or less important. An important goal for almost all such compositions is chemical stability for long periods of time over a broad temperature range.

Other goals which may be of greater or lesser importance depending on the application include action to remove grease and/or particulate soil, to deodorize, to disinfect (killing both bacterial and vial micro-organisms), to remove stains, to remove mildew, to bleach, and to preserve color of the material being cleaned.

Another desirable characteristic is the capability of use for industrial or commercial purposes or in the home. In industry, such compositions are commonly purchased in concentrated form and diluted by the user, thus saving on shipping, packaging, and storage expenses. In the home or small establishments, the convenience of a ready to use product is desirable.

Applicants' invention contains no materials which were not heretofore known in the art of cleaning compositions. However, their invention relates to new and unobvious combinations of such materials, which in use provide superior results to those provided by the prior art.

Of the many patents in the art, Applicants believe the following ones are the ones of most interest:

U.S. Pat. No. 4,430,236 discloses an aqueous product containing hydrogen peroxide, a nonionic surfactant or a mixture of a nonionic surfactant and an anionic surfactant. Many other patents show the use of hydrogen peroxide.

U.S. Pat. No. 5,281,280 discloses a mildew remover containing hypochlorite, bicarbonate, and D-limonene. Many other patents exist showing the use of D-limonene, which provides a pleasant citrus-like aroma, as well as cleaning properties.

It appears to be significant that Applicants have found no disclosures of the use of both hydrogen peroxide or an alkaline-stable hydrogen peroxide and a terpene such as D-limonene or orange oil together. Applicant's analysis included the following patents: U.S. Pat. Nos. 2,371,545; 2,886,532; 3,869,401; 4,022,703; 4,130,501; 4,362,706; 4,430,236; 4,530,781; 4,704,225; 4,711,739; 4,749,516; 4,829,897; 4,877,544; 4,900,468; 5,008,030; 5,201,575; 5,130,124; 5,180,514; 5,213,624; 5,281,280; 5,281,354; 5,368,867; 5,376,297; 5,399,282; 5,527,486; 5,531,938; and, 5,549,480. It is believed that this is because conventional wisdom would suggest that such a mixture would be unstable as would most mixtures including hydrogen peroxide or an alkaline-stable peroxide because of its reactivity.

SUMMARY OF THE INVENTION

Accordingly, it is an object of the invention to provide cleaning compositions which include both hydrogen peroxide or an alkaline-stable peroxide, and a terpene such as D-limonene and methods of using the same.

Another object of the invention is to provide cleaning compositions with high stability for long periods of time under a broad range of temperatures.

Still another object of the invention is to provide cleaning compositions which may be prepared in diluted ready to use form or in concentrated form for industrial use.

Yet another object of the invention is to provide improved cleaning compositions with selectable multiple purposes, including degreasing, particulate soil removal, deodorizing, disinfecting, stain removal, mildew removal, bleaching and color preservation for hard, resilient and porous surfaces and fiber products.

These and other objects of the invention are provided by the invention, as described in the following detailed description.

DETAILED DESCRIPTION OF THE INVENTION

Most generally the improved compositions all include a terpene, an anti-oxidant to stabilize the terpene, two anionic surfactants, a nonionic surfactant, and hydrogen peroxide, all in deionized water solution.

The terpene is a terpene hydrocarbon and may be a monoterpene or sesquiterpene, or a mixture of both. The terpene may be acyclic, monocyclic or bicyclic with monocyclic or bicyclic terpenes being preferred. The preferred specific terpene is D-limonene or orange oil, biodegradable products derived from orange rind oil.

The terpene is stabilized with a food grade anti-oxidant, e.g., a butylated hydroxy anisole blend with other materials.

One of the anionic surfactants is preferably isopropylamine salt of linear alkylbenzene sulfonic acid. It is an excellent cleaning surfactant and an effective emulsifier for D-limonene and other terpenes to form an oil-in-water solution. It is very biodegradable because of its linear alkyl group. It greatly facilitates the formulation of a dilutable micro-emulsion concentrate. One commercial name for this is Biosoft –411.

An anionic surfactant which is preferred for the second surfactant is sodium 1-octane sulfonate. It has excellent coupling properties, is an effective wetting agent, surface tension reducer and hydrotrope. It is stable over a wide pH range, has good compatibility with various conventional detergent builders or additives and stability with respect to hydrogen peroxide. A commercial name for this surfactant is Bioterge PAS-8S.

The nonionic surfactant is preferably an alcohol ethoxylate having 10 to 12 carbon atoms. It is the condensation product of an aliphatic alcohol with about 65% weight basis ethylene oxide. It is highly water soluble and has a hydrophile-lipophile (HLB) of 13.1:1. It is available under the commercial name of Neodol 25-9.

Hydrogen peroxide ($H_2O_2$) is an important part of the compositions because it greatly improves the cleaning, deodorizing and disinfecting performance by its addition. Hydrogen peroxide is conveniently supplied in a concentration of 35% by weight in an aqueous solution. Applicants' experiments have shown that this solution remains stable when combined with the other ingredients in a micro-emulsion when the solution is over half of the micro-emulsion.

The present maximum allowable actual concentration of hydrogen peroxide in a product to avoid health and environmental hazards is 7.9%. Products having hydrogen peroxide concentrations of more than 8% require a health hazard warning label. Using a 35% aqueous solution, this translates to a maximum percentage of 22.8% of the peroxide solution in the composition in its concentrated form. In view of the reactivity of hydrogen peroxide and expected greater reactivity when combined with terpenes, it would have been expected that even such a lower concentration would be unstable, but such is not the case. In fact, all formulations are stable for long periods of time and over a broad temperature range, including both those compositions containing a higher hydrogen peroxide percentage than 7.9%. Applicant's experiments have shown that concentrated cleaning compositions having a hydrogen peroxide percentage as high as 25.27% demonstrate maintained product stability. (See product 130 listed in Table 1 where the hydrogen peroxide concentration is 72.2% (72.2% times 35% equals 25.27% hydrogen peroxide)).

Applicants' invention is not limited by any theory expressed herein. However, it is presently believed that these results may come from both the second anionic surfactant and the use of the final ingredient, deionized water. If the water were not deionized, divalent metals could be present and react with the hydrogen peroxide.

Stability may be further improved by the addition of other ingredients, such as chelating agents.

An advantage of all the compositions is that they are clear micro-emulsions. Thus during application to surfaces or materials, the surfaces can be seen by the users and the progress can be observed.

Generally, the actual concentration of hydrogen peroxide is varied downward from the 7.9% level discussed above depending on the risk of contact with human skin in actual use. The highest concentrations may be used in commercial or industrial use where the compositions are sold in bulk quantities and are to be diluted just before use. In compositions sold for use in the household, dilution is not expected, so the hydrogen peroxide level is the lowest. Other variations will be based on the materials to be cleaned and the specific purposes. None of the compositions are intended for use as body cleaners.

Table 1 sets forth formulations for six compositions within the scope of the invention, with Product Numbers 110, 120, 130, 140, 141, and 142. These are not, however, to be construed as limiting examples. Applicants' experiments have shown that effective formulations outside the scope of those found in Table 1 are not only possible but desirable in many settings. Terpene levels can range from about 0.01% to about 30%. Terpene levels greater than 7.08% saturate the antioxidant of 0.02%. As terpene levels increase, antioxidant levels must also increase to stabilize the terpene. Antioxidant levels of up to about 4% may be necessary to stabilize terpene at 30%.

Hydrogen peroxide can range from about 2% to about 72.2% by weight of a 35% by weight aqueous solution. Alkaline-stable peroxide can range from about 0.7% to 25.27% by weight. Necessarily, the levels of the following components will range from 0.0% to about 15%: water soluble glycol ether, an isopropylamine salt of linear alkylbenzene sulfonic acid, sodium 1-octane sulfonate, and alcohol ethoxylate.

Deionized water levels then range from 0% to about 93% to achieve the proper formulation dilution, and polyacrylate-polyalcohol polymer levels can range from 0.0% to about 5% to achieve desired consistency.

All of the ingredients of Products 110 and 120 have been disclosed above. Product 110 is a multi-purpose product with high percentages of active ingredients. It is intended for dilution just before use and is sold to commercial and industrial users. Product 120 is much less concentrated and is sold in ready to use form as a household all purpose cleaner.

Product 130 is much more concentrated with hydrogen peroxide and is sold for applications for industrial markets and markets where the high level of detergency of the product is desirable.

Product 140 is another formulation for industrial or commercial use with appropriate high concentration. This product (as well as Products 141 and 142) includes an additional water soluble co-solvent, namely a glycol ether. Hence, these three products are all superior when such soils are part of the problem.

Product 141 and Product 142 both additionally include a thickening agent, a modified polyacrylate-polyalcohol polymer commercially available under the name Thix. The increased viscosity and the other variations in percentages make Product 141 more useful as a carpet spotter because it safeguards the color of the carpet and eliminates odors. Product 142 has an increase in hydrogen peroxide and a decrease in deionized water relative to Product 141. It is preferred for more stringent fiber cleaning and deodorization, for example, when pet soil is a problem. Both products 141 and 142 are intended for undiluted household use.

TABLE 1

| Ingredient | 110 | 120 | 130 | 140 | 141 | 142 |
|---|---|---|---|---|---|---|
| D-limonene | 7.08% | 1.32% | 7.08% | 6.58% | 0.55% | 0.55% |
| Anti-oxidant | 0.02% | 0.02% | 0.02% | 0.02% | 0.02% | 0.02% |
| Glycol Ether | 0.00% | 0.00% | 0.00% | 7.00% | 0.58% | 0.58% |
| Biosoft-411 | 8.55% | 1.60% | 8.55% | 7.95% | 0.66% | 0.66% |
| Neodol 25-9 | 6.41% | 1.20% | 6.41% | 5.96% | 0.50% | 0.50% |
| Bioterge PAS-8S | 5.74% | 1.07% | 5.74% | 5.34% | 0.44% | 0.44% |
| DiWater | 49.61% | 92.01% | 0.00% | 44.51% | 93.41% | 92.21% |
| $H_2O_2$ (35%) | 22.60% | 2.80% | 72.2% | 22.60% | 2.80% | 4.00% |
| Thix | 0.00% | 0.00% | 0.00% | 0.00% | 1.00% | 1.00% |
| Total | 100.00% | 100.00% | 100.00% | 100.00% | 100.00% | 100.00% |

TABLE 1-continued

| Ingredient | 110 | 120 | 130 | 140 | 141 | 142 |
|---|---|---|---|---|---|---|
| Description of Ingredients for the Above Formulation Table | | | | | | |
| D-limonene | A terpene derived from distilled orange rind oil. | | | | | |
| Orange Oil | A terpene derived from orange extract. | | | | | |
| Anti-oxidant | A butylated hydroxy anisole blends. | | | | | |
| Glycol Ether | Ethylene glycol monobutyl ether. | | | | | |
| Biosoft-411 | Isopropylamine salt of linear alkybenzene sulfonic acid. (Anionic surfactant) | | | | | |
| Neodol 25-9 | An alcohol ethoxylate having 12 to 15 carbon atoms. (Nonionic surfactant) | | | | | |
| Bioterge PAS-8S | Sodium 1-octane sulfonate. (Anionic surfactant) | | | | | |
| DiWater | Deionized water. | | | | | |
| $H_2O_2$ (35%) | hydrogen peroxide bleach 35% weight solution in water. | | | | | |
| Thix | A modified polyacrylate-polyalcohol polymer. (Thickening agent) | | | | | |

Table 2 discloses seven broad uses of Applicants' compositions with numerous specific uses comprised therein. The first column states the uses. The second column references the formulations disclosed in Table 1. The third column states the desired dilution, if any before use. The fourth column states the remaining steps of the method of use.

TABLE 3

| ratio | 110 | 120 | 130 | 140 | 141 | 142 |
|---|---|---|---|---|---|---|
| % Isopropylamine Salt of Linear Alkylbenzene Sulfonic Acid per 1% D-limonene | 1.2 | 1.2 | 1.2 | 1.2 | 1.2 | 1.2 |
| % alcohol ethoxylate per 1% D-limonene | 0.9 | 0.9 | 0.9 | 0.9 | 0.9 | 0.9 |
| % sodium 1-octane sulfonate per 1% D-limonene | 0.8 | 0.8 | 0.8 | 0.8 | 0.8 | 0.8 |
| % Isopropylamine Salt of Linear Alkylbenzene Sulfonic Acid per 1% alcohol ethoxylate | 1.3 | 1.3 | 1.3 | 1.3 | 1.3 | 1.3 |
| % Isopropylamine Salt of Linear Alkylbenzene Sulfonic Acid per 1% sodium 1-octane sulfonate | 1.1 | 1.1 | 1.1 | 1.1 | 1.1 | 1.1 |

TABLE 3-continued

| ratio | 110 | 120 | 130 | 140 | 141 | 142 |
|---|---|---|---|---|---|---|
| % alcohol ethoxylate per 1% sodium 1-octane sulfonate | 1.1 | 1.1 | 1.1 | 1.1 | 1.1 | 1.1 |

The values presented in Table 3 are derived from Table 1. Table 3 is a summary of the ratios of the isopropylamine salt of linear alkybenzene sulfonic acid to D-limonene and sodium 1-octane sulfonate. As shown in Table 3, the ratios between the isopropylamine salt of linear alkybenzene sulfonic acid, D-limonene and sodium 1-octane sulfonate are substantially constant between product formulations. As such, the percent by weight of these three components can be varied with respect to the remaining components, while maintaining an operable cleaning composition.

Various changes and modifications will be apparent to those skilled in the art. All of these are to be included within the scope of the appended claims.

EXHIBIT "A"

TABLE 2

| CLAIM | APPLICABLE FORMULA | WATER TO FORMULA RATIO | METHOD |
|---|---|---|---|
| FOR USE AS A MULTI-PURPOSE CLEANER. Formulations may be balanced to provide a broad range of cleaning effectiveness without possibility of damage to any water-safe surface or fiber. Each specific application's cleaning needs are effectively satisfied by varying the water to cleaner ratio at the work site. Applications effectively satisfied by one formula are:<br>1. Cleaning Hard & resilient surfaces<br>2. Cleaning Glass & mirrors<br>3. Cleaning & disinfecting Bathroom urinals, commodes, sinks & fixtures<br>4. Cleaning & removing spots from Fibers . . . ie. Carpet, upholstery, Fabrics | 110 (Commercial)<br>120 (Household)<br>130 (Industrial & Commercial)<br>140 (Commercial) | 10:1 to 1000:1<br>0:1 to 100:1<br>10:1 to 1000:1<br>10:1 to 1000:1 | Commercial products 110, 130 and 140 are diluted in the field by means of a venturi eductor driven with water pressure to provide multiple levels of water dilution automatically to satisfy a broad range of cleaning needs<br>1. 10:1 Strong spray and wipe cleaner for very heavy soil grease and renovation<br>2. 20:1 Degreasing solution for kitchens and mechanical Working areas<br>3. 54:1 A Pre-spray and soak method is used for heavily Soiled floors or walls, carpets, bathroom urinals, commodes, sinks, fixtures and walls, stalls and floors adjacent to those areas.<br>4. 256:1 No rinse wipe down cleaner and bathroom floor moping solution<br>5. 512:1 General mop bucket and mechanical scrubbing equipment solution. Glass and mirror cleaner<br>6. 1000:1 Mechanical scrubbing machine solution for high gloss floors |
| FOR USE IN ELIMINATION OF ODORS. These formulations are particularly effective for soluablizing soils and oxidizing odors associated with urine, feces, decomposing food, smoke, and mildew. | 110 (Commercial)<br>120 (Household)<br>130 (Industrial & Commercial)<br>140 (Commercial)<br>141 (Household)<br>142 (Household) | 10:1 to 54:1<br>0:1 to 10:1<br>10:1 to 256:1<br>10:1 to 54:1<br>0:1<br>0:1 | The affected surface is sprayed with the appropriate dilution and allowed to soak for three to fifteen minutes depending on the severity type of soil and surface. The affected surface is then scrubbed and rinsed with water to remove soils and residual cleaner. |
| FOR USE AS A DISINFECTANT. These formulations demonstrate effective bacteria destruction properties for Gram Positive and Gram Negative Bacteria as well as Yeast and Mold. | 110 (Commercial)<br>120 (Household)<br>130 (Industrial & Commercial)<br>140 (Commercial)<br>141 (Household)<br>142 (Household) | 10:1 to 54:1<br>0:1<br>10:1 to 128:1<br>10:1 to 54:1<br>0:1<br>0:1 | The affected area is sprayed with the appropriate dilution (lower water dilutions result in stronger disenfectant properties). The affected area is allowed to soak for one to ten minutes depending on the dilution ratio (lower water dilutions work faster). The affected area is then scrubbed or wiped and or rinsed with water (higher water dilutions do not require rinsing). |
| FOR USE ON HARD & RESILIENT SURFACES. These formulations are effective cleaning agents for hard or resilient surfaces at high water dilution ratios. Products using this technology provide penetrating solvency for porous surfaces. Bleaching action is surface-safe and particularly effective on grouted ceramic tile. | 110 (Commercial)<br>120 (Household)<br>140 (Commercial)<br>141 (Household)<br>142 (Household) | 10:1 to 1000:1<br>0:1 to 100:1<br>10:1 to 1000:1<br>0:1<br>0:1 | The surface is cleaned by mop or mechanical scrubbing machines at appropriate dilution levels. For heavy soils the lower dilutions are pre-sprayed on the surface and allowed to soak for three to fifteen minutes and then scrubbed and rinsed water. |
| FOR USE TO CLEAN & BLEACH FIBERS. Formulations based on this technology provide effective color-safe cleaning, and bleaching without damage to fibers in carpet, upholstery, fabric and other fiber materials. | 110 (Commercial)<br>120 (Household)<br>140 (Commercial)<br>141 (Household)<br>142 (Household) | 10:1 to 500:1<br>0:1 to 10:1<br>10:1 to 500:1<br>0:1<br>0:1 | Method one: Soiled surface is sprayed or soaked with the appropriate dilution and allowed to soak for three to fifteen minutes. The surface is then scrubbed or wiped clean and rinsed with water.<br>Method two: the soiled surface is sprayed with the appropriate dilution and allowed to soak for ten to fifteen minutes. An industry standard carpet extraction machine is filled with 500:1 dilution and the surface is rinsed and extracted a standard practice. |
| FOR USE AS STAIN REMOVER. Formulations based on this technology provide color-safe, effective removal of blood, body fluids, ink, food, smoke and other organic stains from all water-safe surfaces and fibers. | 110 (Commercial)<br>120 (Household)<br>140 (Commercial)<br>141 (Household)<br>142 (Household) | 10:1 to 256:1<br>0:1 to 10:1<br>10:1 to 256:1<br>0:1<br>0:1 | The affected surface is sprayed with the appropriate dilution and allowed to soak for three to fifteen minutes depending on the severity type of soil and surface. The affected surface is then scrubbed and rinsed with water to remove soils and residual cleaner. |

TABLE 2-continued

| CLAIM | APPLICABLE FORMULA | WATER TO FORMULA RATIO | METHOD |
|---|---|---|---|
| FOR USE TO REMOVE MILDEW AND IT'S ASSOCIATED ODOR. Formulations based on this technology provide color-safe, effective removal and oxidation of mildew and it's odor, without risk of damage to any water-safe surface or fabric | 110 (Commercial)<br>120 (Household)<br>140 (Commercial)<br>141 (Household)<br>142 (Household) | 10:1 to 256:1<br>0:1 to 10:1<br>10:1 to 256:1<br>0:1<br>0:1 | The affected surface is sprayed with the appropriate dilution and allowed to soak for three to fifteen minutes depending on the severity, and surface type. The affected surface is then scrubbed and rinsed with water to remove mildew and residual cleaner |

What is claimed is:

1. A cleaning composition formed by combining a group of starting materials, said group of starting materials comprising:

a group of oil soluble components, said group of oil soluble components comprising:

a terpene;

an alkali metal salt of linear alkylbenzene sulfonic acid, said alkali metal salt of linear alkylbenzene sulfonic acid comprising approximately 1.2 percent by weight per 1 percent by weight of said terpene;

an alcohol ethoxylate, said alcohol ethoxylate comprising approximately 0.9 percent by weight per 1 percent by weight of said terpene; and an alkali metal salt of alkyl sulfonate, said alkyl sulfonate comprising approximately 0.8 percent by weight per 1 percent by weight of said terpene;

said group of starting materials further comprising an effective terpene stabilizing amount of an anti-oxidant;

hydrogen peroxide; and de-ionized water.

2. The cleaning composition of claim 1, wherein said terpene is d-limonene.

3. The cleaning composition of claim 2, wherein said d-limonene comprises approximately 0.007 to approximately 7 percent by weight of said cleaning composition.

4. The cleaning composition of claim 1, wherein said alkali metal salt of linear alkylbenzene sulfonic acid is an isopropylamine salt of linear alkylbenzene sulfonic acid.

5. The cleaning composition of claim 1, wherein said alkali metal salt of alkyl sulfonate is sodium 1-octane sulfonate.

6. The cleaning composition of claim 1, wherein said wherein said terpene is d-limonene; said alkali metal salt of linear alkylbenzene sulfonic acid is an isopropylamine salt of linear alkylbenzene sulfonic acid; and said alkali metal salt of alkyl sulfonate is sodium 1-octane sulfonate.

7. The cleaning composition of claim 1, wherein said wherein said alcohol ethoxylate comprises 12 to 15 carbon atoms per molecule.

8. The cleaning composition of claim 7, wherein said wherein said alcohol ethoxylate has an HLB value of approximately 13.1.

9. The cleaning composition of claim 1, wherein said anti-oxidant comprises approximately 0.0002 to approximately 0.02 percent by weight of said cleaning composition.

10. The cleaning composition of claim 1, wherein said hydrogen peroxide comprises approximately 0.0226 to approximately 25 percent by weight of said cleaning composition.

11. The cleaning composition of claim 1, wherein said de-ionized water comprises approximately 2 to approximately 72 percent by weight of said cleaning composition.

12. A cleaning composition formed by combining a group of starting materials, said group of starting materials comprising:

a group of oil soluble components, said group of oil soluble components comprising:

d-limonene;

an isopropylamine salt of linear alkylbenzene sulfonic acid, said alkali metal salt of linear alkylbenzene sulfonic acid comprising approximately 1.2 percent by weight per 1 percent by weight of said terpene;

an alcohol ethoxylate, said alcohol ethoxylate comprising approximately 0.9 percent by weight per 1 percent by weight of said terpene; and sodium 1-octane sulfonate, said alkyl sulfonate comprising approximately 0.8 percent by weight per 1 percent by weight of said terpene;

said group of starting materials comprising an effective terpene stabilizing amount of an anti-oxidant;

hydrogen peroxide; and de-ionized water.

13. The cleaning composition of claim 12, wherein said wherein said alcohol ethoxylate comprises 12 to 15 carbon atoms per molecule.

14. The cleaning composition of claim 13, wherein said wherein said alcohol ethoxylate has an HLB value of approximately 13.1.

15. The cleaning composition of claim 12, wherein said d-limonene comprises approximately 0.007 to approximately 7 percent by weight of said cleaning composition.

16. The cleaning composition of claim 12, wherein said anti-oxidant comprises approximately 0.00002 to approximately 0.02 percent by weight of said cleaning composition.

17. The cleaning composition of claim 12, wherein said hydrogen peroxide comprises approximately 0.0226 to approximately 25 percent by weight of said cleaning composition.

18. The cleaning composition of claim 12, wherein said de-ionized water comprises approximately 2 to approximately 72 percent by weight of said cleaning composition.

19. A method for forming a cleaning composition, comprising:

combining a group of starting materials to form a concentrate, said group of starting materials comprising:

a group of oil soluble components, said group of oil soluble components comprising:

a terpene;

an alkali metal salt of linear alkylbenzene sulfonic acid, said alkali metal salt of linear alkylbenzene sulfonic acid comprising approximately 1.2 percent by weight per 1 percent by weight of said terpene;

an alcohol ethoxylate, said alcohol ethoxylate comprising approximately 0.9 percent by weight per 1 percent by weight of said terpene; and an alkali metal salt of alkyl sulfonate, said alkyl sulfonate comprising approximately 0.8 percent by weight per 1 percent by weight of said terpene;

said group of starting materials further comprising an effective terpene stabilizing amount of an anti-oxidant; and hydrogen peroxide; and combining said concentrate with de-ionized water to form said cleaning composition.

20. The method of claim 19, wherein said terpene is d-limonene.

21. The method of claim 20, wherein said d-limonene comprises approximately 0.007 to approximately 7 percent by weight of said cleaning composition.

22. The method of claim 19, wherein said alkali metal salt of linear alkylbenzene sulfonic acid is an isopropylamine salt of linear alkylbenzene sulfonic acid.

23. The method of claim 19, wherein said alkali metal salt of alkyl sulfonate is sodium 1-octane sulfonate.

24. The method of claim 19, wherein said wherein said terpene is d-limonene; said alkali metal salt of linear alkylbenzene sulfonic acid is an isopropylamine salt of linear alkylbenzene sulfonic acid; and said alkali metal salt of alkyl sulfonate is sodium 1-octane sulfonate.

25. The method of claim 19, wherein said wherein said alcohol ethoxylate comprises 12 to 15 carbon atoms.

26. The method of claim 19, wherein said wherein said alcohol ethoxylate has an HLB value of approximately 13.1.

27. The method of claim 19, wherein said anti-oxidant comprises approximately 0.00002 to approximately 0.02 percent by weight of said cleaning composition.

28. The method of claim 19, wherein said hydrogen peroxide comprises approximately 0.0226 to approximately 25 percent of said cleaning composition.

29. The method of claim 19,wherein said de-ionized water comprises approximately 2 to approximately 72 percent by weight of said cleaning composition.

* * * * *